United States Patent [19]

Carl

[11] Patent Number: 4,545,326

[45] Date of Patent: Oct. 8, 1985

[54] LIQUID TONER APPLICATOR

[75] Inventor: Norman J. Carl, La Habra, Calif.

[73] Assignee: Sanders Associates, Inc., Nashua, N.H.

[21] Appl. No.: 582,698

[22] Filed: Feb. 23, 1984

[51] Int. Cl.[4] ..... G03G 15/10

[52] U.S. Cl. ..... 118/660; 118/411; 355/10

[58] Field of Search ..... 118/660, 410, 411; 355/10; 354/317

[56] References Cited

U.S. PATENT DOCUMENTS

| | | | |
|---|---|---|---|
| 3,929,099 | 12/1975 | Szymber et al. | 118/650 |
| 4,198,923 | 4/1980 | Blumenthal | 118/660 |
| 4,289,092 | 9/1981 | McChesney et al. | 118/660 |

*Primary Examiner*—Evan K. Lawrence

*Attorney, Agent, or Firm*—Louis Etlinger; Wm. F. Porter, Jr.

[57] ABSTRACT

A liquid toner applicator includes a hollow housing or manifold divided into two channels. A wall of the housing common to both channels is composed of a multi-layer lamination of thin sheet layers, such as etched metal foils. The outermost wall layer constituting the bearing surface for the recording medium is formed with a pattern of slots for applying toner to the exposure surface of the medium. The innermost wall layer is formed with two sets of holes, each set being open to different housing channels. The remaining wall layers between the innermost and outermost layers are each formed with an array of slots or holes which combine and interconnect in the wall lamination to provide a first network of precisely defined toner feed pathways between one of the housing channels and one end of each of the slots in the outermost wall layer and a second network of precisely defined toner recovery pathways between the opposite end of each of the slots in the outermost layer and the other housing channel. A pump connected between the housing channels and a source of liquid toner circulates fresh toner through the channels and wall pathways so that fresh toner flows uniformly in thin layers along the slots in the outermost wall layer whereby the entire exposure surface of a recording medium is exposed uniformly to the toner as the medium advances across the applicator.

17 Claims, 4 Drawing Figures

LIQUID TONER APPLICATOR

This invention relates to a liquid development system and more particularly to a toner applicator or head for applying liquid toner to a recording medium in order to develop an image recorded electrostatically on that medium.

BACKGROUND OF THE INVENTION

In direct, as opposed to transfer, electrography or xerography, a recording medium such as paper is advanced past a succession of processing stations. First, an electrostatic charge is impressed on the photoconductive surface of the paper. Then, the paper is exposed to a light image of an original document or record with the result that those areas of the paper that receive light are discharged while the remaining areas of the paper which are not illuminated retain their charge so that a electrostatic latent image corresponding to the original document is impressed on the paper. That image is then developed by applying liquid toner to the paper. The toner contains resin binder and black or colored pigment or particles suspended in a carrier liquid. The particles carry an electric charge that is oposite that of the paper so that the particles migrate and adhere to only to those areas on the paper which still carry an electric charge whereby the latent image on the paper is reduced to visible form. Finally, the developed image on the paper is fixed by passing the paper through a dryer which heats the binder thereby bonding the toner to the paper, creating a permanent copy of the original document or record.

Similar image recorders make reproductions on dielectric recording media. In those, only the aforementioned steps of charging and toning take place in the recording apparatus.

We are concerned here specifically with the toner applicator at the toning station of such recording apparatus which distributes liquid toner across the charged exposure surface of the recording medium, and which is critical to the creation of high quality reproductions of an original document or record. We will describe the invention as incorporated into recording apparatus using a photosensitive recording medium. It should be understood, however, that it is equally applicable for use in recorders such as those marketed by Sanders Associates, Inc. under the designation CALCOMP which make reproductions on dielectric recording media.

Conventional applicators have a working or bearing surface that contacts the photoconductive surface of the medium. A multiplicity of small passages lead from locations on that bearing surface to a source of liquid toner. The liquid is pumped through the passages forming a film between the head and the recording medium. Some heads also include other passages maintained at a negative pressure for removing excess toner from the medium surface. Examples of such toner applicators are disclosed in U.S. Pat. Nos. 3,929,099; 3,727,578; 4,133,906 and 4,281,620.

While certain existing applicators do fulfill their basic function of distributing toner over the charged surface areas of the recording media, they have serious drawbacks which restrict their ability to develop electrostatic images of high quality at reasonable cost. More particularly, in some prior applicators, the liquid toner is not flowed equally to all regions of the charged exposure surface of the medium with the result that dark areas of the image developed on the medium are nonuniform or blotchy. Some toning heads do achieve uniform flow of liquid over the medium. However, the toner reaching certain portions of the medium surface is partially or totally depleted of toner particles so that the image developed on the medium has regions which are gray instead of black. Some conventional electrographic recorders suffer because the toner is not maintained in contact with the charged surface of the recording medium long enough for an adequate number of toner particles to reach and adhere to the medium surface, again creating a copy having poor contrast. This may be due to the fact that the electrostatic field intensity in the gap between the head and the recording medium is too weak or the residence time of fresh or undepleted toner flowing in that gap is too short. Those applicators which do develop reasonably high contrast, high quality electrographic images on the medium tend to be relatively complicated machined structures which are difficult to manufacture and therefore relatively expensive to make and maintain.

SUMMARY OF THE INVENTION

Accordingly, the present invention aims to provide an improved liquid toner applicator having particular utility in an electrographic recorder.

Another object of the invention is to provide a liquid toner applicator which ensures equal flow of undepleted toner over the entire exposure surface area of a recording medium.

A further object of the invention is to provide an applicator of this type which develops electrostatic latent images on an electrographic recording medium which are of high quality.

Still another object of the invention is to provide a liquid toner applicator or head which is relatively easy and inexpensive to manufacture in quantity.

Another object of the invention is to provide such an applicator which makes efficient use of the liquid toner.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

The liquid toner applicator of the present invention is situated in the electrographic recorder at the toning station between the exposing station where an electrostatic image is applied to the photoconductive surface of the recording medium and the drying station where the developed image on the medium is bonded to the medium to create a permanent copy of the original document or record. The applicator or head comprises an elongated, generally rectangular housing or manifold, open on one side, which is partitioned lengthwise to divide the manifold into two longitudinal chambers or channels, namely a toner delivery channel and a toner collection channel. The open side of the manifold is closed by a fluid distribution plate which consists of a multi-layered lamination of thin sheet layers, such as etched thin metal foils. The plate is rigid and is bonded to the manifold, including its partition, so that one lengthwise section of the innermost layer of the plate is exposed to the toner delivery channel, while the other lengthwise section of that innermost layer is exposed to the toner collection channel. A plurality of small holes extend through that innermost plate layer, one half of these holes being open to each channel.

The outermost layer of the distribution plate constitutes the working or bearing surface of the applicator which actually contacts the surface of the recording medium passing through the toning station. That outermost foil layer is quite thin and it is formed with a pattern of lengthwise slots or cells distributed in columns and rows over substantially its entire area. The cells in the cell pattern are staggered or offset so that, when the recording medium is advanced across the distribution plate, each point on the surface of the medium is moved opposite a plurality of those cells in succession.

The intermediate foil layers of the laminated distribution plate are etched with different patterns of slots or holes to form a fluid distribution system between the two manifold channels and the cells in the outermost layer of the plate. More particularly, the slots and holes in the intermediate layers define two networks of passages through the plate. One network of passages connects the holes in the innermost layer that open to the toner delivery channel to the ends of all of the applicator cells in the outermost layer. The other network of passages connect the opposite ends of all of those cells to the holes of the innermost layer that open to the toner collection channel.

The toner applicator, and more particularly its housing or manifold, is connected to a source of liquid toner and a vacuum pump so that toner is introduced into the toner delivery channel of the manifold and withdrawn from the toner collection channel thereof. When toner is circulated through the head thusly, the fluid pathways formed by the patterns of slots and holes in the plate layers feed the applicator cells at the surface of the head with fresh toner supplied to the manifold delivery channel from the toner supply. The pathways also return the depleted or spent toner from those cells to the toner supply via the return or collection channel of the manifold. Thus, when a recording medium bearing a electrostatic latent image is advanced across the toner applicator or head, with its charged exposure surface in intimate contact with the distribution plate containing the applicator cells, all portions of the exposure surface are drawn opposite a succession of those cells as fresh toner is circulated continuously through the cells.

The holes and slots in the various plate layers that define the fluid pathways through the plate are formed by imaging and etching techniques customarily used in the manufacture of printed circuits. Therefore, the positions and dimensions of those various holes and slots can be controlled very precisely so that the impedance or resistance to flow of the corresponding fluid pathways between all of the applicator cells and the manifold channels can be made substantially the same. This ensures that the toner distribution system in the applicator will provide equal flow of undepleted toner over the entire exposure surface of the recording medium advancing across the applicator.

The utilization in the applicator of a distribution plate composed of etched foils also means that the outer layer of that plate can be made very thin, e.g. 2 mils, so that liquid toner flows along the applicator cells as a thin film . Resultantly, most of the toner particles suspended in the toner liquid must pass very close to the charged surface of the recording medium. Therefore, not only is the time required for those particles to gravitate to the charged media surface minimized, but also the electric field in the gap between the toner applicator and the medium surface at the locations of toner delivery is a maximum thereby maximizing the force tending to accelerate the toner particles toward the medium surface. Both of the above factors ensure that, as the medium passes each applicator cell in the head, a maximum number of toner particles will reach and adhere to the charged areas of the medium.

The construction of the applicator distribution plate as a lamination of individually etched foil layers also permits accurate control of the other dimensions of the applicator cells. Therefore, the slot length can be selected to give the fresh toner a definite residence time in each cell without allowing the toner to become depleted between the time the toner enters and exits the cell. On the other hand, the cell width may be chosen so that the plate provides adequate bearing area for the recording medium moving across the plate without imposing excessive frictional drag on the medium or subjecting the plate to excessive surface wear.

A preferred embodiment of the toner applicator includes means for squeegeeing or doctoring excess liquid toner along the medium surface as the medium exits the applicator. This further insures uniform application of toner particles to the charged areas of the medium surface and further minimizes toner depletion. For this, longitudinal slots are provided in the outer layer of the distribution plate adjacent the exit side of the applicator. These slots communicate through the plate with the toner collection channel of the manifold. Since that channel is maintained under negative pressure, a vacuum is present at those slots causing air pressure to press the paper or other recording medium against the plate along a line extending across the medium. That pressure line on the paper functions as a squeegee or doctor blade and spreads any excess liquid toner along the exiting medium surface so that the excess toner is not just carried out of the toning station into the drying station and lost.

As noted above, the applicator distribution plate can be made with a very high degree of precision using standard photoetching and laminating techniques. The dual-channel manifold component of the applicator may be composed of simple extrusions and the remaining components of the applicator are more or less standard parts. Therefore the applicator as a whole, while achieving superior performance, can be made at less cost than prior comparable toner applicators which require the manufacture and assembly of expensive machined parts.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
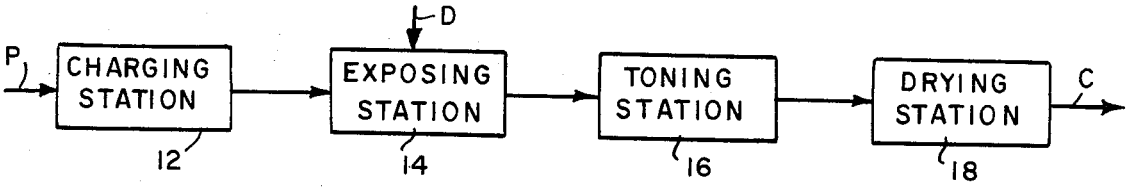
FIG. 1 is a schematic illustration of the processing stations in an electrographic recorder.

Referring first to FIG. 1 of the drawings, the series of steps typically accomplished to make an electrographic reproduction of an original document or record is shown there. First, an electrographic recording medium P, e.g., paper, is advanced through a charging station 12 which applies an electrostatic charge, say a negative charge, to the photoconductive surface of the medium. Then, the medium passes to an exposing station 14 which includes a lens system that projects an image of the original document D onto the charged exposure surface of the medium. Those regions of that surface exposed to light lose their electrostatic charge, while those regions which are not illuminated retain their charge so that an electrostatic latent image of the original document D is impressed upon the surface of the medium. Then the medium advances through a toning station 16 which is the subject of the present invention. In that station, liquid toner containing a suspension of electrostatically charged, e.g. positive, toner particles is distributed over the surface of the medium, adhering only to those regions thereof which still carry an electric charge. The toner particles are opaque or dark so that the latent image on the medium is developed and becomes visible. Finally, the medium bearing the developed image is advanced through a drying station 18 which cures the resin component of the liquid toner, thereby fusing or bonding the toner particles to the medium creating a permanent copy C of the original document D.

Figure 2:
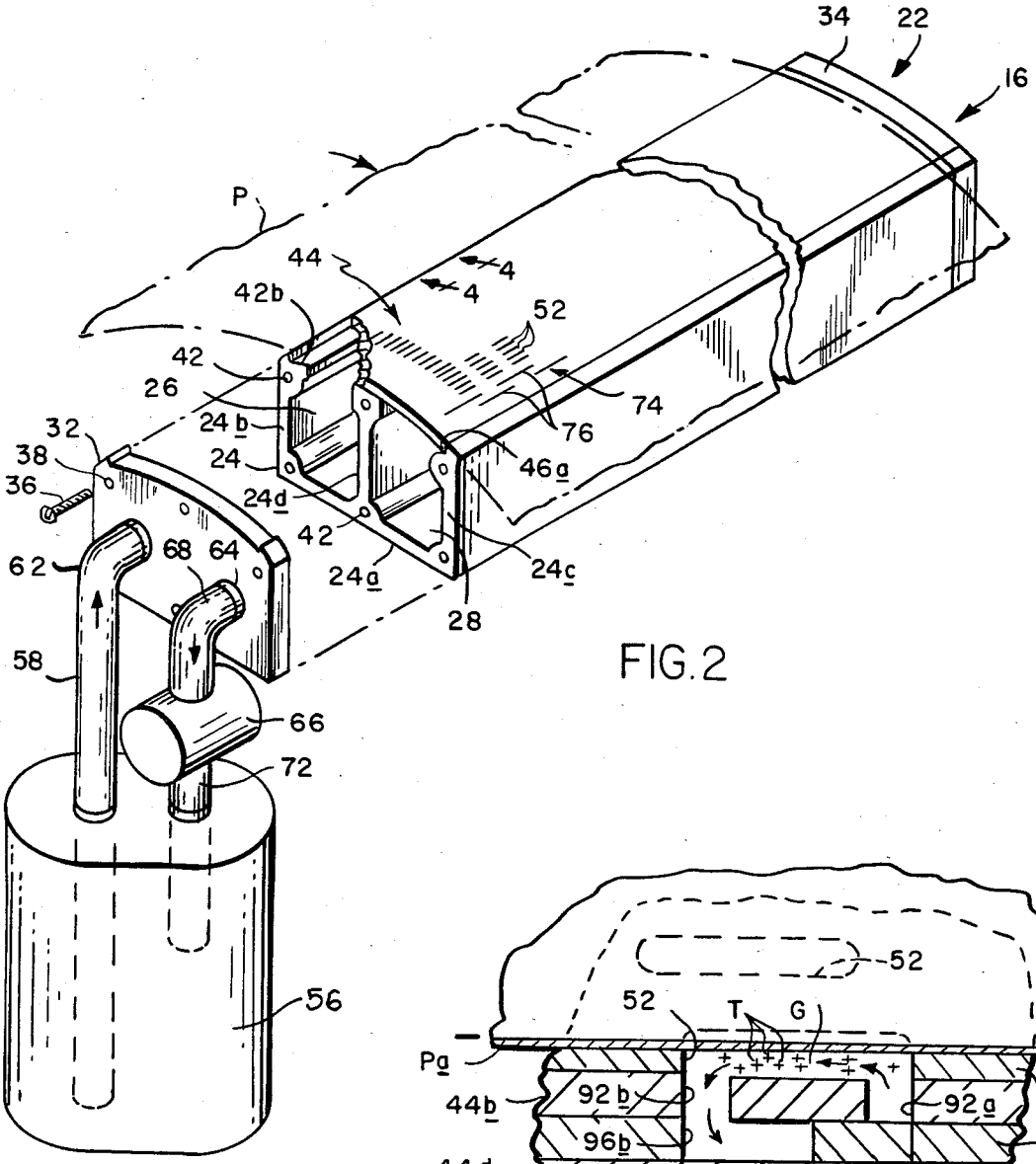
FIG. 2 is an exploded perspective view with parts broken away showing the liquid toner applicator at the toning station of the FIG. 1 recorder.

FIG. 2 shows the liquid toner applicator or head 22 which actually distributes the toner particles over the medium exposure surface at station 16. The applicator includes an elongated generally rectangular housing or manifold 24 having a bottom wall 24*a* and a pair of spaced-apart parallel side walls 24*b* and 24*c*. A lengthwise partition wall 24*d* extends up from bottom wall 24*a* midway between the two manifold side walls thereby dividing the manifold into two longitudinal chambers or channels 26 and 28. The side of the manifold opposite wall 24*a* is open, as are the ends of the manifold. Those ends are closed by similar end plates 32 and 34. The plates are secured to the ends of the manifold by threaded fasteners 36 extending through openings 38 spaced around the edge margins of the end plates and turned down into threaded holes 42 in the ends of the manifold. If desired, appropriate gaskets or seals (not shown) may be provided between the end plates and the manifold ends to prevent fluid leakage. The manifold 24 can be formed as an aluminum extrusion. Likewise, the end plates 32 and 34 can be sliced as slabs from a single extrusion. Therefore, those parts are quite inexpensive to make.

The open side of the manifold 22 is closed by a special distribution plate indicated generally at 44 which completely fills the space between the manifold side walls 24*b* and 24*c* and end plates 32 and 34. Plate 44 bridges the partition wall 24*d*, which is somewhat higher than the other manifold walls, so that the plate 44 is gently bowed or arched from one side of the applicator to the other. The upper edges of the manifold side walls 24*b* and 24*c* are recessed to form ledges 46*a* and 46*b* so that, when the side edge margins of plate 44 are seated on the ledges, the exposed surface of the plate is flush with the upper edges of plates 32 and 34, as well as with the edges of the manifold side walls which are themselves beveled to conform to the curvature of the plate. Those side margins of the plate are bonded to ledges 46*a* and 46*b* by appropriate means such as epoxy cement. Likewise, the inner surface of the plate 44 is bonded to the upper edge of the partition wall 24*d*. This divides the inner surface of the plate 44 lengthwise into two strips, one strip being exposed to the manifold channel 26 and the other strip being exposed to manifold channel 28.

Still referring to FIG. 2, the outer surface of plate 44 which is engaged by medium P as that passes through the toning station is formed with a pattern or array of lengthwise slots or cells 52 which are arranged in columns and rows extending over substantially the entire area of plate 44. As will be seen presently, plate 44 is formed so that fluid communication is established through the plate between manifold channel 26 and one end of each cell 52 as well as between the manifold channel 28 and the other end of each cell 52. Liquid toner from a container 56 is delivered via a conduit 58 connected to an inlet port 62 in end plate 32 to manifold channel 26, which thus constitutes a toner delivery channel. Toner is withdrawn from the other channel 28, the toner collection channel, through an outlet port 64 in plate 32 by a vacuum pump 66 connected to that port by a conduit 68. The pump delivers the liquid back to container 56 by way of a conduit 72.

The liquid toner delivered to the manifold channel 26 is distributed by plate 44 to one end of each of the applicator cells 52 in the outer surface of that plate. The toner travels as a thin film along each cell and returns through plate 44 to the toner collection channel 28, whence it is returned by pump 66 to container 56. Thus, fresh toner from container 56 is circulated continuously along all of the applicator cells 52 where it is brought into intimate contact with the opposing photoconductive surface Pa of the medium P advancing across the head.

The arrangement of cells 52 on the head is such that, as the medium moves across the head, each point on medium surface Pa encounters a succession of cells 52. Thus, in the illustrated cell pattern, the cells are arranged in columns and rows, with the columns being staggered. The length of distribution plate 44 is commensurate with the width of the recording medium, thirty-six inches being a typical length. One and a half inches is a typical plate width. This width provides a sufficient number of slot 52 rows to ensure adequate exposure of the recording medium to the toner present in cells 52 and the requisite amount of wrap of the medium about the applicator to ensure intimate contact between the opposing surfaces of the plate 44 and medium P.

Still referring to FIG. 2, the illustrated toner applicator 22 also includes a so-called air knife or doctor blade shown generally at 74 which extends the length of the plate adjacent to manifold wall 24*c* at the exit side of the applicator. The air knife consists of two offset rows of lengthwise slots 76. These slots extend parallel to cells 52 and they are somewhat longer than those cells. The slots are connected via a network of passageways through plate 44 to the toner collection channel 28. During operation of the applicator, the negative pressure maintained in channel 28 by pump 66 draws a vacuum at slots 76. Therefore, air pressure on the medium P presses the medium against the plate along the line of slots thereby creating a dam or doctor blade which spreads or squeegees any excess liquid toner back along the surface of the medium as the medium leaves the applicator. While the air knife 74 is not necessary for proper operation of the applicator, it does assure that substantially all of the toner fed to cells 52 is used constructively to coat the medium P so that most efficient use is made of the available toner in container 56.

Figure 3:
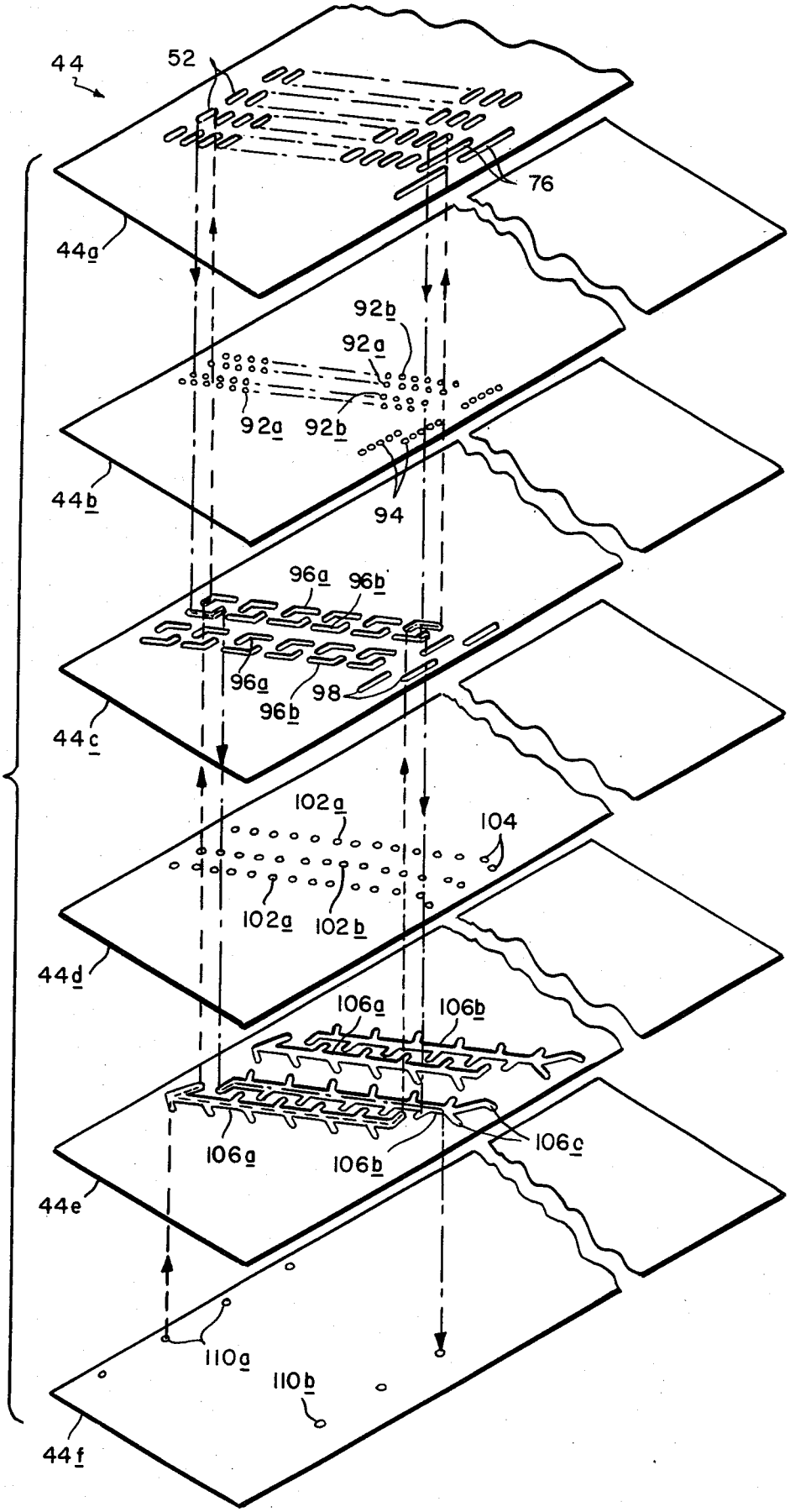
FIG. 3 is an exploded perspective view on a slightly larger scale illustrating a part of the FIG. 2 applicator in greater detail.

Refer now to FIG. 3 which shows the distribution plate 44 in greater detail. As seen there, the plate comprises a lamination of six rectangular thin sheets or foils of a conductive material such as aluminum or stainless steel. In a typical plate, the outermost foil layer 44*a* is on the order of two mils thick, while layers 44*b*, 44*d* and 44*f* are about five mils in thickness. The remaining two layers 44*c* and 44*e* are approximately ten mils thick. These foil layers are formed from larger foil sheets by a conventional chemical etching process of the type commonly employed to manufacture printed circuits. There are also formed in the foil layers during the etching process different patterns of holes or slots arranged in rows and/or columns.

For ease of illustration, only some of the columns of slots or holes in the pattern in each layer are shown, the illustrated columns being repeated along the entire length of the particular layer. Also, each pattern actually includes many more rows of openings than are shown and the individual slots and holes are much smaller than depicted. Further, while FIG. 3 shows the vertical alignment of the slots and holes in the various plate layers when the layers are flat, that illustrated alignment actually exists when the layers are bowed or arched as shown in FIG. 2.

In any event, the pattern of applicator cells 52 and air knife slots 76 described above are etched in the top plate layer 44*a*. It should be understood that the words "top", "bottom", etc. as used herein should not imply any particular orientation of the plate on the applicator as a whole. A pattern of small holes is formed in layer 44*b* under the cell pattern 52 in layer 44*a*. These holes are arranged in rows and staggered columns with the holes in alternate columns being numbered 92*a* and 92*b*. Layer 44*b* also contains two offset rows of grouped holes 94 located under the air knife slots 76 in layer 44*a*. Plate layer 44*c* contains a pattern of L-shaped slots arranged in rows and staggered columns, the slots in alternate columns being numbered alternately 96*a* and 96*b*. Slots 96*a* are more or less upright "Ls", while the slots 96*b* are upside down and reversed "Ls", all of the slots being located generally under the pattern of holes 92*a*, 92*b* in layer 44*b*. Also, layer 44*c* includes two offset rows of lengthwise slots 98 located under the rows of holes 94 in layer 44*b*.

The plate layer 44*d* is formed with an array of small holes arranged in rows and staggered columns, the holes in alternate columns being numbered 102*a* and 102*b* respectively. That array of holes is located under the pattern of slots 96*a*, 96*b* in layer 44*c*. Also formed in layer 44*d* are two rows of holes 104 which are positioned under the slots 98 in layer 44*c*. The plate layer 44*e* contains two sets of interlaced branched diagonal slots 106*a* and 106*b*. The shapes of the branched slots are difficult to describe in words. Suffice it to say that the slots are located under the pattern of holes 102*a*, 102*b* in layer 44*d* and extend between the endmost rows of those holes. Each slot 106*b* includes end branches 106*c* that extend under the rows of holes 104 in layer 44*d*. Finally, the innermost foil layer 44*f* contains a row of spaced holes 110*a* adjacent the left-hand edge margin of that layer more or less under the lower ends of slots 106*a*. A second row of holes 110*b* is located adjacent the opposite edge of that layer more or less under the ends of slots 106*b* in layer 44*e*.

The bowed layers 44*a* to 44*f* are laminated together to form plate 44 using a suitable bonding agent such as epoxy resin without obstructing the patterns of holes and slots etched into the layers. When the plate is mounted to the manifold as described above and as shown in FIG. 2, the holes 110*a* in the innermost plate layer 44*f* are open to the toner delivery channel 26, while the holes 110*b* therein are exposed to the toner collection manifold 28 and the holes and slots in the various layers have the vertical alignment shown in FIG. 3.

More particularly, a branch of each slot 106*a* in layer 44*e* lies opposite a hole 110*a* in the bottom layer, while a segment of each slot 106*b* in layer 44*e* is disposed opposite a hole 110*b* in the bottom layer. The holes 102*a* and 102*b* in layer 44*d* are arranged so that branches of slots 106*a* extend opposite holes 102*a* in the same column and branches of slots 106*b* are disposed opposite holes 102*b* in the same column. Since there are twelve branches in each slot 106*a* and 106*b*, each hole 110*a* in layer 44*f* feeds twelve holes 102*a* in layer 44*d* and each hole 110*b* communicates with twelve holes 102*b*.

Each hole 102*a* is aligned with the short leg of a slot 96*a* in layer 44*c* and each hole 102*b* is aligned with the short leg of a slot 96*b* in that same layer. The long leg of each slot 96*a* communicates with three adjacent holes 92*a* in the same column of the hole pattern in layer 44*b* and the long leg of each slot 96*b* opens to three adjacent holes 92*b* of layer 44*b*. Thus, each hole 102*a* in layer 44*d* feeds three holes 92*a* in layer 44*b* and each hole 102*b* communicates with three holes 92*b* in layer 44*b*. These patterns yield a total multiplication factor of 36 ($12\times3$) so that 36 holes 92*a* and 36 holes 92*b* are fed from each of the holes 110*a* and 110*b* respectively in layer 44*f*. As further shown in FIG. 3, the adjacent holes 92*a* and 92*b* in each row of holes formed in layer 44*b* are located directly under the opposite ends of a cell 52 in the uppermost plate layer 44*a*.

Thus, the slots and holes in the various plate layers combine to provide a system of precisely defined pathways for feeding fresh toner from manifold channel 26 to the applicator cells 52 and for recovering partially depleted toner from those cells for collection in the manifold channel 28 from where it is returned by pump 66 to container 56 (FIG. 2). With the illustrated etched plate layers 44*a* to 44*f* which are only one and a half inches long and thirty-six inches long, fresh toner may be circulated through as many as 2650 or more cells 52 formed in a plate layer 44*a*.

The air knife slots 76 in plate layer 44*a* communicate through the rows of holes 94, slots 98, holes 104 and slot branches 106*c* in layers 44*b* to 44*e* respectively, with the holes 110*b* that open to the toner recovery channel 28. As noted above, that channel is maintained at a negative pressure by pump 66 so that some air is drawn in through cells 52 along with the partially depleted liquid toner creating the squeegee effect discussed above which removes excess toner from the medium P.

Figure 4:
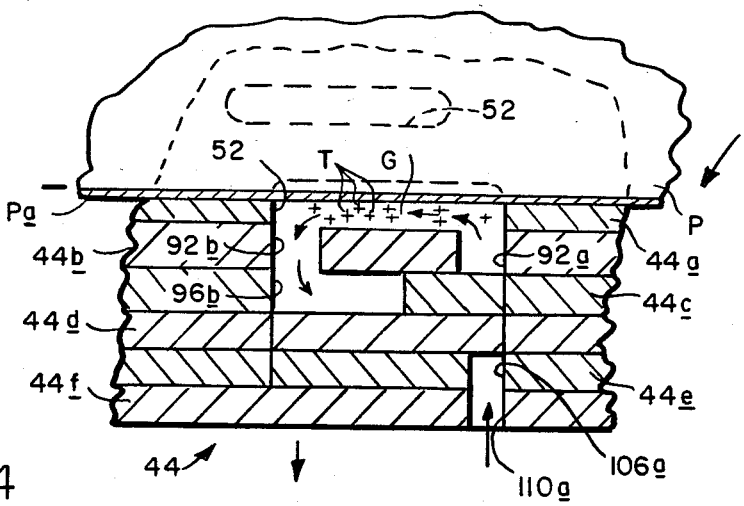
FIG. 4 is a fragmentary sectional view on a still larger scale taken along line 4—4 of FIG. 2.

Referring now to FIG. 4, due to the construction of the toner distribution plate 44 as a multi-layer lamination of etched thin foils, the dimensions of the various slots and holes in the plate layers can be controlled to a very high degree of accuracy. Consequently, the overall dimensions and flow characteristics of the fluid pathways to and from the applicator cells 52 that are defined by those etched slots and holes can likewise be controlled so that the corresponding pathways for all of the applicator cells have precisely the same impedance or resistance to flow. Further, with this arrangement, that impedance can be made relatively high even though the total thickness of the plate 44 is small, e.g. 27 mils. This means that uniform amounts of fresh toner T will be circulated through all of the applicator cells 52 so that the developing process is carried out uniformly over the entire working area of the plate 44. That factor, coupled with the fact that the recording medium P encounters a succession of cells 52 as it advances, across plate 44 ensures that toner particles are applied uniformly to the entire exposure surface Pa of the medium. The aforementioned air knife 74 also helps in that respect.

Other important advantages accruing because of the construction of plate 44 as a lamination of etched thin foils are the uniformity and small depth that can be obtained for the applicator cells 52. More particularly, when the recording medium passes across the distribution plate 44, an electric field is developed in the gap G between the bottom of the gap, i.e. plate layer 44*b*, and the negatively charged surface Pa of the recording medium. If the gap is uniform, the intensity of that field is uniform at all points inside the gap. Also, since the intensity of that field for a given dielectric charge on surface Pa is inversely proportional to the gap length, a short gap G means that a very strong field can be developed in the gap through which the liquid toner circulates. Therefore the force acting to accelerate the positively charged toner T particles (which is proportional to the field intensity and the particle charge magnitude) can be made quite high. Still further, the thinness of layer 44*a* assures that the liquid toner flows through gap G as a very thin layer or film so that a maximum number of toner particles are flowed very close to the medium surface Pa. Both of these factors maximize the chances of a toner particle in a cell 52 reaching and adhering to a charged region of the medium surface Pa.

In other words, the small depth of gap G minimizes the time it takes for the toner particles to travel from each cell 52 to a charged portion of the medium surface Pa and maximizes the intensity of the electric field that propels those particles to that surface. This is quite important because, as the toner particles attach themselves to surface Pa, the field intensity in gap G drops thereby diminishing the toner particle application rate as surface charges are being satisfied. The optimum gap G length, then, for a given applicator is a compromise between a gap length that produces maximum field intensity and one that permits flow of the requisite amount of fresh toner T along the gap in a given time.

In this connection, the gap length produced by a foil layer 44*a* thickness of about two mils has been found to be satisfactory. The residence time of the toner in gap G depends to a great extent on the length of gap G, i.e., the length of each cell 52. This length should be selected so that the toner nearing the exit end of the slot is not depleted of toner particles. This result has been achieved with a gap or cell length of about one-quarter inch. The width of cells 52 controls to a large extent the bearing area on plate 44 for supporting the recording medium P. A cell width of about 0.04 inch has been found to provide adequate bearing area without causing excessive surface wear of the plate or frictional drag on the recording medium. The exposure of the recording medium to toner depends, of course, on the number and position of the applicator cells 52. As noted above, these are present in sufficient numbers to cover the entire exposed surface area of the recording medium and so that each point on that area is exposed to a plurality of applicator cells from which to receive toner particles.

By the time each increment of recording medium surface Pa reaches air knife 74, a uniform and adequate number of toner particles have reached all charged portions of that increment. However, at that knife, even more toner particles are brought into contact with those charged surface portions due to the squeegee or doctoring action of the air knife described above. Resultantly, by the time each medium surface increment exits the toner applicator 22, its charged surface portions are assuredly covered uniformly with the requisite density of toner particles required to produce a high contrast reproduction of the original document.

It will be seen from the foregoing, then, that the present liquid toner applicator develops an electrostatic latent image of superior quality quickly and reliably. Yet, because the applicator distribution plate 44 is formed as a lamination of etched thin metal foils and the remaining major components of the head are simple extrusions, the overall cost of the applicator is a minimum; indeed, it is far less than the cost of prior comparable toner applicators and heads which utilize or require expensive machined parts. Therefore, when incorporated into an electrographic recorder, the present applicator helps to reduce the overall cost of that recorder, while improving the quality of the document or record reproduced by the recorder.

It will thus be seen that the objects set forth above, among those made apparent from the preceding description, are efficiently attained. Also, certain changes may be made in the above construction without departing from the scope of the invention. For example, plate 44 may be composed of more or fewer layers depending upon the flow impedance and multiplication or branching factor desired for the plate. Likewise, the dimensions and shapes of the slots and holes in the plates may vary from those specifically illustrated. Therefore, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A liquid toner applicator comprising

A. a plate having a surface for supporting and distributing liquid toner to the surface of a recording medium, said plate being composed of a lamination of thin sheet layer, the outermost layer of the plate being adjacent to the surface of the recording medium;

B. means in said outermost layer of the plate defining a pattern of openings extending through that layer to said surface at locations spaced over said surface;

C. means in the innermost layer of the plate defining first and second sets of openings through said innermost layer, each of said first and second sets of openings containing fewer openings than are present in said pattern of openings in said outermost layer;

D. a dual channel manifold;

E. means for mounting said plate to said manifold so that (1) said first set of openings are open to one channel of the manifold, and (2) said second set of openings are open to the other channel of said manifold; and F. means defining a pattern of additional openings through each of the remaining layers of said plate between said outermost and innermost layers, said additional openings being shaped and positioned in their respective layers so that they combine in the lamination of layers to produce a first network of pathways communicating between said first set of openings and first locations in the openings of said pattern of openings in said outermost layer and a second network of pathways different from the first communicating between second locations in the openings of said pattern of openings in said outermost layer and said second set of openings.

2. The liquid toner applicator defined in claim 1 wherein said layers and said openings in said layers are dimensioned to provide substantially the same fluid flow impedances in the corresponding pathways between said manifold channels and each of said openings in the pattern of openings in said outermost layer.

3. The liquid toner applicator defined in claim 2 and further including means for delivering liquid toner to one of said manifold channels and withdrawing liquid toner from the other of said manifold channels so that toner circulates through said pathways and flows as a thin layer along each of said openins in said outemost layer substantially flush with said plate surface.

4. The liquid toner applicator defined in claim 3 wherein the delivering and withdrawing means comprise A. a toner supply;

B. a vacuum pump; and

C. conduit means connecting the supply and pump in series with said manifold channels so that the pump draws a vacuum in one of said channels.

5. The liquid toner applicator defined in claim 1 wherein said manifold comprises A. an extruded metal channel;

B. said plate layers are thin metal foils; and

C. the opening-defining means comprise etchings in said foils.

6. The liquid toner applicator defined in claim 1 and further including means located between an edge of said outermost layer and said pattern of openings in said outermost layer for removing excess toner from said plate surface.

7. The liquid toner applicator defined in claim 6 wherein said removing means comprise A. a series of holes in said outermost layer; and B. means communicating through said plate layers between said series of holes and one said manifold channel, said on manifold channel being connected to means for drawing a vacuum.

8. The liquid toner applicator defined in claim 7 wherein the communicating means comprise additional arrays of interconnecting holes or slots in plate layers between said outermost layer and said one manifold.

9. The liquid toner applicator defined in claim 1 wherein the openings in said pattern of openings in said outermost layer are arranged in columns and rows with adjacent openings in said columns or rows being offset.

10. A liquid toner applicator comprising

A. a wall for supporting a recording medium, said wall being composed of a multi-layer lamination of thin metal sheets, (1) the outermost layer of said wall being adjacent to said recording medium and being formed with a pattern of spaced apart slots through said top layer, (2) the innermost layer of said wall being formed with first and second spaced-apart sets of one or more holes through said bottom layer, and (3) each thin metal layer of said wall between said top and bottom layers being formed with a pattern of slots or holes, said slots or holes combining in said wall lamination to produce a network of toner feed passages extending from said first set of holes in the bottom layer to a first location in each of said slots in said top layer and a network of toner recovery passages extending between a second location in each of said slots in said top layer to the second set of holes in said bottom layer; and B. means for delivering fresh liquid toner to said first set of holes and collecting depleted liquid toner from said second set of holes.

11. The liquid toner applicator defined in claim 10 wherein said outermost layer has a thickness of about 2 mils and each of said slots in said outermost layer is about one-quarter inch long and less than 0.06 inch wide.

12. The liquid toner applicator defined in claim 10 wherein said layers are aluminum or stainless steel foils.

13. The liquid toner applicator defined in claim 10 and further including a dual-channel manifold mounted to the innermost layer of said wall, one channel of the manifold being open to said first set of holes and the other channel of the manifold being open to the second set of holes.

14. The liquid toner application defined in claim 13 wherein the toner delivering and collecting means further include A. a liquid toner supply;

B. a vacuum pump; and

C. conduit means for connecting said supply and vacuum pump in series with said manifold channels so that said pump draws a vacuum in said other channel whereby depeleted toner is withdrawn from said other channel into said supply and fresh toner is flowed from said supply into said one channel.

15. The liquid toner applicator defined in claim 14 and further including A. a line of openings in said outermost layer between said slot pattern therein and an edge of said outermost layer; and B. one or more additional openings in said layers between said outermost layer and said manifold, said additional openings combining in the wall lamination to provide a fluid path between said line of openings in said outermost layer and said other channel whereby the vacuum drawn in said other channel by the pump also appears at said line of openings thereby to form an air knife for removing excess toner from a recording medium advancing across said wall.

16. The liquid toner applicator defined in claim 10 wherein said slots and holes in the wall layers are dimensioned so that the corresponding pathways to and from the slots in said outermost layer all have substantially the same fluid impedances.

17. The liquid toner applicator defined in claim 10 wherein the patterns of holes or slots in said wall layers between said outermost and innermost layers are shaped to achieve a multiplication of the number of slots in said outermost layer that can be served by each set of holes in said innermost layer.

* * * * *